US006622931B2

(12) United States Patent
Bonningue

(10) Patent No.: US 6,622,931 B2
(45) Date of Patent: Sep. 23, 2003

(54) CLEANABLE DISPENSING HEAD AND DISPENSER INCLUDING THE SAME

(75) Inventor: Philippe Bonningue, Paris (FR)

(73) Assignee: L'Oreal S.A., Paris (FR)

( * ) Notice: Subject to any disclaimer, the term of this patent is extended or adjusted under 35 U.S.C. 154(b) by 90 days.

(21) Appl. No.: 09/874,230

(22) Filed: Jun. 6, 2001

(65) Prior Publication Data

US 2002/0017574 A1 Feb. 14, 2002

(30) Foreign Application Priority Data

Jun. 6, 2000 (FR) ..... 00 07234

(51) Int. Cl.[7] ..... B05B 17/00
(52) U.S. Cl. ..... 239/1; 239/333; 239/337
(58) Field of Search ..... 239/333, 337, 239/491, 106, 1; 222/102.11; 220/345.1, 345.2, 345.3, 811, 812

(56) References Cited

U.S. PATENT DOCUMENTS

| | | | | |
|---|---|---|---|---|
| 2,989,251 A | | 6/1961 | Abplanalp et al. | |
| 3,319,894 A | | 5/1967 | Cooprider | |
| 3,659,758 A | * | 5/1972 | Waterman | 222/561 |
| 3,848,778 A | * | 11/1974 | Meshberg | 222/402.11 |
| 3,961,756 A | | 6/1976 | Martini | |
| 4,253,609 A | | 3/1981 | Laauwe | |
| 5,803,371 A | | 9/1998 | Sugiyama et al. | |
| 5,992,704 A | | 11/1999 | Jäger-Waldau | |
| 6,367,711 B1 | * | 4/2002 | Benoist | 239/115 |
| 6,439,442 B1 | * | 8/2002 | Markert et al. | 222/547 |

FOREIGN PATENT DOCUMENTS

| | | |
|---|---|---|
| EP | 0 726 096 | 8/1996 |
| EP | 0 790 079 | 8/1997 |
| EP | 1 016 464 | 7/2000 |
| FR | 2 698 854 | 6/1994 |
| FR | 2 787 731 | 6/2000 |
| WO | WO 96/31412 | 10/1996 |
| WO | WO 97/31841 | 9/1997 |

OTHER PUBLICATIONS

English language Derwent Abstract of FR 2 698 854, Jun. 10, 1994.

Co–pending Application No. 09/987,515; Title: Dispensing Head and Assembly Including the Same, Inventor(s): Jean–François Benoist, U.S. Filing Date: Nov. 15, 2001.

English language Derwent Abstract of EP 1 016 464, Jul. 5, 2000.

English language Derwent Abstract of FR 2 787 731, Jun. 30, 2000.

* cited by examiner

*Primary Examiner*—Lisa A. Douglas
(74) *Attorney, Agent, or Firm*—Finnegan, Henderson, Farabow, Garrett & Dunner, L.L.P.

(57) ABSTRACT

A dispensing head is provided for actuating a valve or a pump and for dispensing a product through at least one dispensing orifice. The dispensing head comprises a body and an end element. The body may be configured for coupling to an operating stem of the valve or of the pump. The end element includes a dispensing orifice and is movable with respect to the body. When the dispensing head is mounted on the pump stem or valve stem, the dispensing orifice is in communication with the stem via at least one passage. The end element is capable of being positioned to allow the cleaning of all or part of a dispensing duct. The end element is capable of being translated and pivoted relative to the body. A dispenser assembly may be equipped with this dispensing head.

52 Claims, 7 Drawing Sheets

X
21
22C
22
22a
II
21b
24
20
20c
18
20a
6
II
60
22b
1
2
4

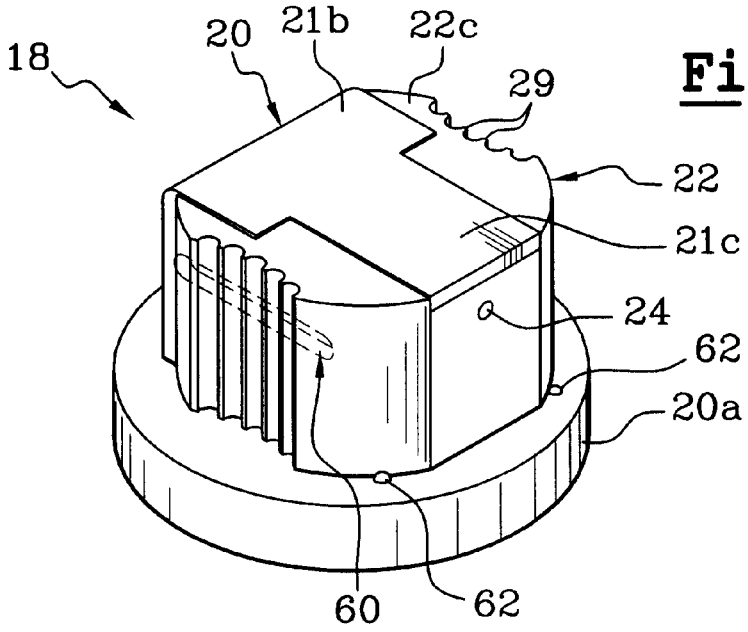
Fig. 9
Fig. 10
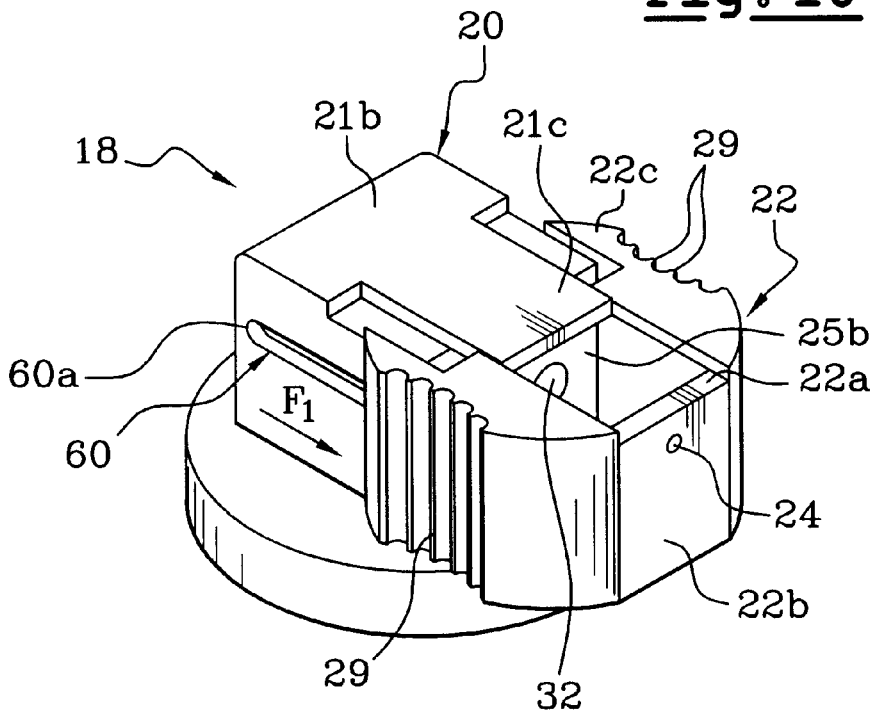

CLEANABLE DISPENSING HEAD AND DISPENSER INCLUDING THE SAME

The present invention relates to a dispensing head intended to equip a dispenser for a fluid product, such as a dispenser wherein product is dispensed in the form of a jet or a spray, for example An aspect of the invention also relates to a dispenser equipped with such a dispensing head In general, some fluid dispensers comprise a reservoir containing a product that is to be dispensed and a dispensing member fixed to an open end of the reservoir. The dispensing member may be a pump or a valve and the dispensing member may be coupled to a dispensing device. The dispensing device typically fulfills two functions. On the one hand, the dispensing device allows the user to actuate the dispensing member, so as to eject a dose of product from the reservoir On the other hand, the dispensing device allows the product leaving the reservoir to be conveyed via a conveying duct to a dispensing orifice, for example in the form of a nozzle, with which the dispensing device is provided. Product may then be dispensed in the form of a somewhat string-like jet or alternatively in the form of a cloud of fine droplets, known as a spray. The product may be conveyed to the dispensing orifice by simple pressure on a compressible product reservoir. When the dispenser is equipped with a dispensing valve, the reservoir may contain a pressurized gas for propelling the product that is to be dispensed through the dispensing orifice.

Conventionally, a dispensing device for dispensing product in the form of a jet or of a spray comprises a body equipped with a conveying duct in fluid communication with the product reservoir. The conveying duct is in fluid communication with a dispensing nozzle equipped with an outlet orifice of small cross section. Customarily, a nozzle such as this is an attached part fixed, at the time of manufacture, to the dispensing device in a non-removable way.

Certain products, particularly over a lengthy period of non-use, tend to clog the dispensing device, for example with product residues. With dispensers currently on the market, it is practically impossible to unblock or clean the nozzle and/or the conveying duct, without causing damage to the dispensing device, which is detrimental to subsequent use of the dispenser Such a clogging phenomenon may occur quite often when the product is a solution or a dispersion which readily dries out in ambient air. Such products may be in the form of spray adhesives, paints, or certain cosmetic or dermopharmaceutical products, such as products for conditioning the hair and the skin, such as hair lacquers or antisun products.

U.S. Pat. No. 3,961,756 discloses a spray head comprising a nozzle screwed onto a free end of the product conveying duct. Turning the nozzle makes it possible, by displacing the nozzle along the product jet outlet axis, to modify the characteristics of the spray obtained. It is also possible to remove this nozzle in order to clean it, should it become clogged. However, it is difficult to access the conveying ducts with a view to unblocking them, if clogging occurs Furthermore, it is difficult to readjust the nozzle after it has been refitted, which means that it is not possible to obtain a constant quality of spray, after cleaning, until numerous adjustment operations have been performed. In addition, the nozzle described cannot be obtained by moulding, or can be so only with difficulty, and has to be machined from metal, which adversely affects its cost price. Finally, as the nozzle is displaced along the axis of the jet, it is essential, in order to avoid the nozzle being expelled under the pressure of the jet, for it to be secured by a connection of the screw-fastening type.

A cleanable nozzle device for fluid products is described elsewhere, in WO-A-96/31 412. This nozzle device comprises a fixed part and a removable part making it possible, in the event of clogging, to access the dispensing orifice and the terminal part of the product conveying duct. The removable part can be detached on a plane passing through the center of the dispensing orifice. The edge of the dispensing orifice is delimited by two different parts and when the dispensing orifice is very small in size, it may be impossible to obtain an even edge around the dispensing orifice, particularly as a result of the presence of an assembly joint. This results in an irregular and rough spray. As a result, it is impossible to obtain a regular cone of spray with a uniform distribution of droplet sizes.

Another source, EP-A-0 726 096, describes a spray head in which the dispensing orifice can move with respect to an annular swirl chamber and ducts supplying it with product. The objective of this device is to vary the divergence characteristics of the spray obtained. Access to this swirl chamber and/or to its supply ducts, with a view to clearing these, is not possible.

In the case of other spray heads or nozzle devices, for instance, as described in U.S. Pat. No. 2,989,251, U.S. Pat. No. 3,319,894, FR-A-2 698 854 or EP-A-0 790 079, no provision is made for removing or temporarily opening up the spray heads or nozzle devices with a view to clearing the supply ducts they contain.

Accordingly, one of the optional objects of the invention is to provide a dispensing head, a dispensing assembly and a method for cleaning a dispensing head that solve all or some of the problems or short-comings of the related art. For example, the device may be reliable, easy to use and inexpensive.

Hence, one of the optional objects of the invention is to supply a dispensing head, which can easily be cleaned without complicated disassembly. In particular, the dispensing head may have a two-part structure which makes it possible to avoid losing one of the constituent parts.

Yet another optional object of the invention relates to a dispensing head which is easy to disassemble and to fit after clearing.

Another optional object of the invention relates to a dispensing head capable of producing a jet or a regular spray of uniformly distributed fine droplets.

It should be understood that the invention could still be practiced without performing one or more of the optional objects and/or advantages described above. Still other optional objects will become apparent from the detailed description that follows.

As broadly described herein, the invention includes a dispensing head for actuation a dispensing member provided on a dispenser. The dispensing head may include a body, an end element and at least one dispensing duct. The body may be configured to be operatively coupled to the dispensing member. The end element may include a dispensing orifice Moreover, the end element may be movable with respect to the body (e.g. movable coupled directly or indirectly to the body) between a closed position and an opened position, wherein the movement includes at least one translational movement of the end element and at least one pivoting movement of the end element about a pivot axis. With the end element in the closed position, flow communication between the dispensing orifice and the dispensing member may be allowed This flow communication may occur via the at least one dispensing duct when the body is operatively coupled to the dispensing member. Further, when the end element is in the opened position, at least a portion of the at least one dispensing duct may be capable of being cleaned.

Another optional aspect of the invention relates to a dispensing head intended for actuating a valve or a pump and for dispensing a product through at least one dispensing orifice. The dispensing head may include a body configured for coupling to an operating stem of the valve or of the pump and an end element that includes the dispensing orifice When the dispensing head is in a position in which it is mounted on the pump stem or valve stem, this dispensing orifice may be in communication with the pump stem or valve stem via at least one passage. The end element may be capable of being placed in a position allowing the cleaning of all or part of the passage or duct in response to the end element being displaced with respect to the body in a first movement of translation, and in a second movement of pivoting about an axis.

Optionally, the first movement is along a first axis on which the dispensing orifice is centered, i.e., the first axis is coincident with the longitudinal axis of the dispensing orifice.

For example, the second movement may be about a second axis perpendicular to the first axis.

In order to perform the first and second movements, one of the body or the end element may include a guide element, for instance, a grove, slot or channel. The other of the body or the end element may include a catching element, for instance, a stud or other projection, which is intended to engage the guide element.

In an optional embodiment, in the opened or retracted position, the end element is secured to the body of the dispensing head. For this purpose, the guide element, in collaboration with the catching element, may allow the end element to be secured to the body of the dispensing head when the end element is in the opened position.

Optionally, the end element may be restrained from being displaced, via a pivoting movement or via a translational movement, relative to the body when the end element is in the closed position. For example, either the body or the end element may include at least one raised pip for inhibiting translational movement of the end element relative to the body when the end element is in the closed position.

With regard to the second axis, this axis may be defined by the catching element, for instance, a stud, studs or other projections.

The end element may be mounted on the body in such a way as to be able to be placed in the opened or retracted position in response to a translational movement followed by a pivoting movement through about 180 degrees with respect to the body.

Displacement of the end element relative to the body from the closed position to the opened position, may optionally be accomplished via a first translational movement, a first pivoting movement, a second translational movement and a second pivoting movement The product supplying passage or duct optionally includes a swirl chamber upstream of the dispensing orifice. This swirl chamber may be capable of imparting to the stream of product, just before it passes through the dispensing orifice, an accelerating movement in a converging spiral. This accelerating movement may cause the product to break up into particularly fine droplets after it has passed through the dispensing orifice This effect is particularly useful, for example, when use is being made of a pump with precompression, or of a dispensing valve in combination with a compressed propellant gas that is not soluble in the product For instance, optionally, either the body or the end element includes a swirl chamber. The swirl chamber may optionally be delimited by the other of the body or the end element. The swirl chamber may include profiles that at least partially define dispensing passages of decreasing cross-sectional area.

According to one optional embodiment, the passage connecting the operating stem to the dispensing orifice may be partly delimited by the end element.

According to another optional provision of the invention, the end element partly delimits the swirl chamber. In this case, a sealing element, formed, for instance, by a portion of the end element, may be provided to seal the dispensing duct or passages. Optionally, the sealing element may be formed by a portion of the body Optionally, the dispensing head of the invention is shaped as a pushbutton with a pressing surface, on which the user presses in order to cause a dose of product to be ejected or sprayed.

Another optional aspect relates to a dispensing head for a dispenser including a dispensing member. The dispensing head may include a body, an end element, at least one guide element and at least one catching element. The body may define at least a portion of at least one dispensing duct. The dispensing duct may be configured to provide flow communication with the dispensing member when the dispensing head is operatively coupled to the dispensing member. The end element may include a dispensing orifice and the end element may be movably coupled to the body for movement from a closed position to an opened position. The guide element may be defined by one of the body or the end element. The catching element may be defined by the other of the body or the end element and the catching element may slidably engage the guide element during at least a portion of the movement of the end element from the closed position to the opened position. The catching element may define a pivoting axis around which the end element pivots relative to the body during at least a portion of the movement of the end element from the closed position to the opened position.

Even another optional aspect relates to a dispensing head for a dispenser including a dispensing member, wherein the dispensing head may include a body configured to be operatively coupled to the dispensing member and an end element including a dispensing orifice. The body may define a portion of a dispensing duct. The end element may be movably coupled to the body. The body may include a groove and the end element may include a stud. The stud may move in the groove when the end element moves from a closed position to an open position.

Another optional aspect relates to an assembly for packaging and dispensing a product, particularly a cosmetic one. The assembly may comprise a dispensing member, for instance, a pump or a valve, and the dispensing head.

The dispensing assembly may include a reservoir for packaging the product, a dispensing member operatively associated with the reservoir, and the dispensing head. The product may optionally be a cosmetic product, and optionally, this cosmetic product may include a solvent or be capable of undergoing oxidation.

When this assembly includes a dispensing member, the product may be conveyed to the dispensing member, for example, by means of a pressurized propellant gas, acting directly or indirectly on the product contained in a reservoir with which the assembly is provided. Optionally, the dispensing member may be a valve. For example, the dispensing member may be a push-in valve or a lateral tilt valve. Optionally, the dispensing member may be a pump.

In yet another optional aspect, a method for cleaning product residue from a dispensing head is provided. The method includes translating the end element relative to the body and pivoting the end element relative to the body to thereby gain access to the dispensing duct. The method further includes removing product residue from the dispensing duct, and pivoting and translating the end element relative to said body to thereby place the dispensing orifice in flow communication with the dispensing duct.

Optionally, the end element may be translated along a straight line or a curvilinear line, or both.

Another optional aspect relates to a method for cleaning product residue from a dispensing head comprised of a body and an end element movable with respect to the body. The method includes translating the end element relative to the body, pivoting the end element relative to the body to thereby gain access to a dispensing duct defined at least in part by the body, and removing product residue from the dispensing duct The method further includes pivoting the end element relative to the body, and translating the end element relative to the body to thereby place a dispensing orifice defined by the end element in flow communication with the dispensing duct.

Besides the structural arrangements and procedural aspects described above, there could include a number of other arrangements, such as those explained hereinafter. It is to be understood that both the foregoing description and the following description are exemplary.

The accompanying drawings are incorporated in and constitute a part of this specification. The drawings illustrate optional embodiments of the invention. In the drawings, FIG. 1 depicts a perspective view of a dispensing assembly, equipped with a dispensing head, according to one optional embodiment of the invention;

FIG. 2 illustrates a partial cross-sectional view in plane II—II of FIG. 1;

FIG. 3*a* is a perspective view of the dispensing head of FIG. 1, in the process of assembly;

FIG. 3*b* is a perspective view of an end member of FIG. 3*a;*

FIG. 9 depicts a perspective view of a dispensing head according to a second optional embodiment of the invention;

FIG. 10 depicts a perspective view of the dispensing head of FIG. 9 in a first stage of opening;

Figure 1:
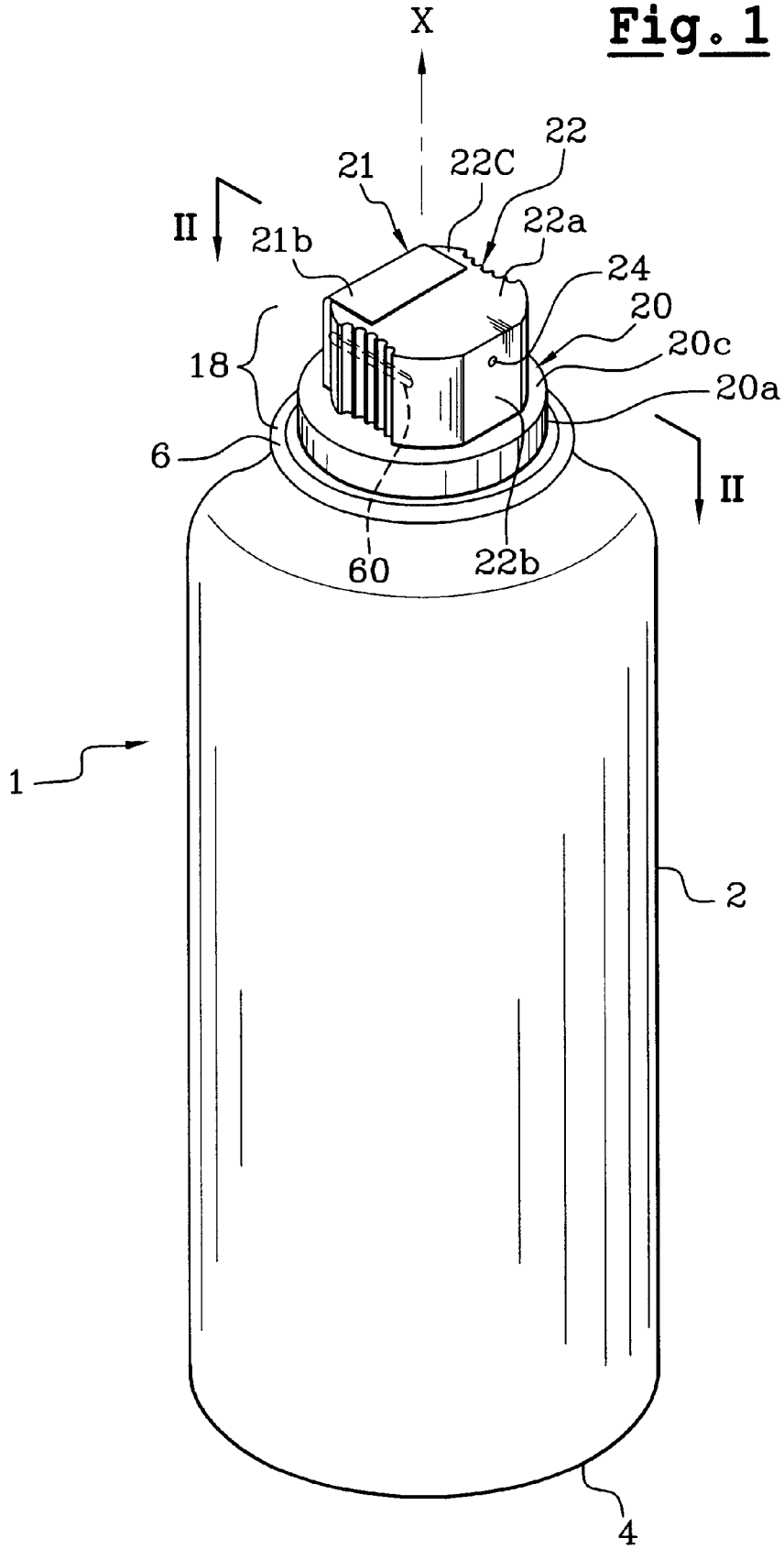

Reference will now be made in detail to optional embodiments of the invention, examples of which are illustrated in the accompanying drawings Whenever possible, the same reference numbers are used in the drawings and the description to refer to the same or like parts, and the same reference numbers with alphabetical suffixes are used to refer to sub-portions of the part having the same reference number.

Refering to these figures, particularly to FIG. 1, the reference number 1 has generally been used to denote a dispensing assembly according to one optional embodiment of the invention. The dispensing assembly 1 includes a cylindrical reservoir 2, typically of the metal can type, and having an axis X. The reservoir 2 may contain a liquid product P such as, for instance, a cosmetic product such as a hair lacquer. The reservoir may be pressurized using a propellant gas, of the liquefiable or compressed type.

Figure 2:
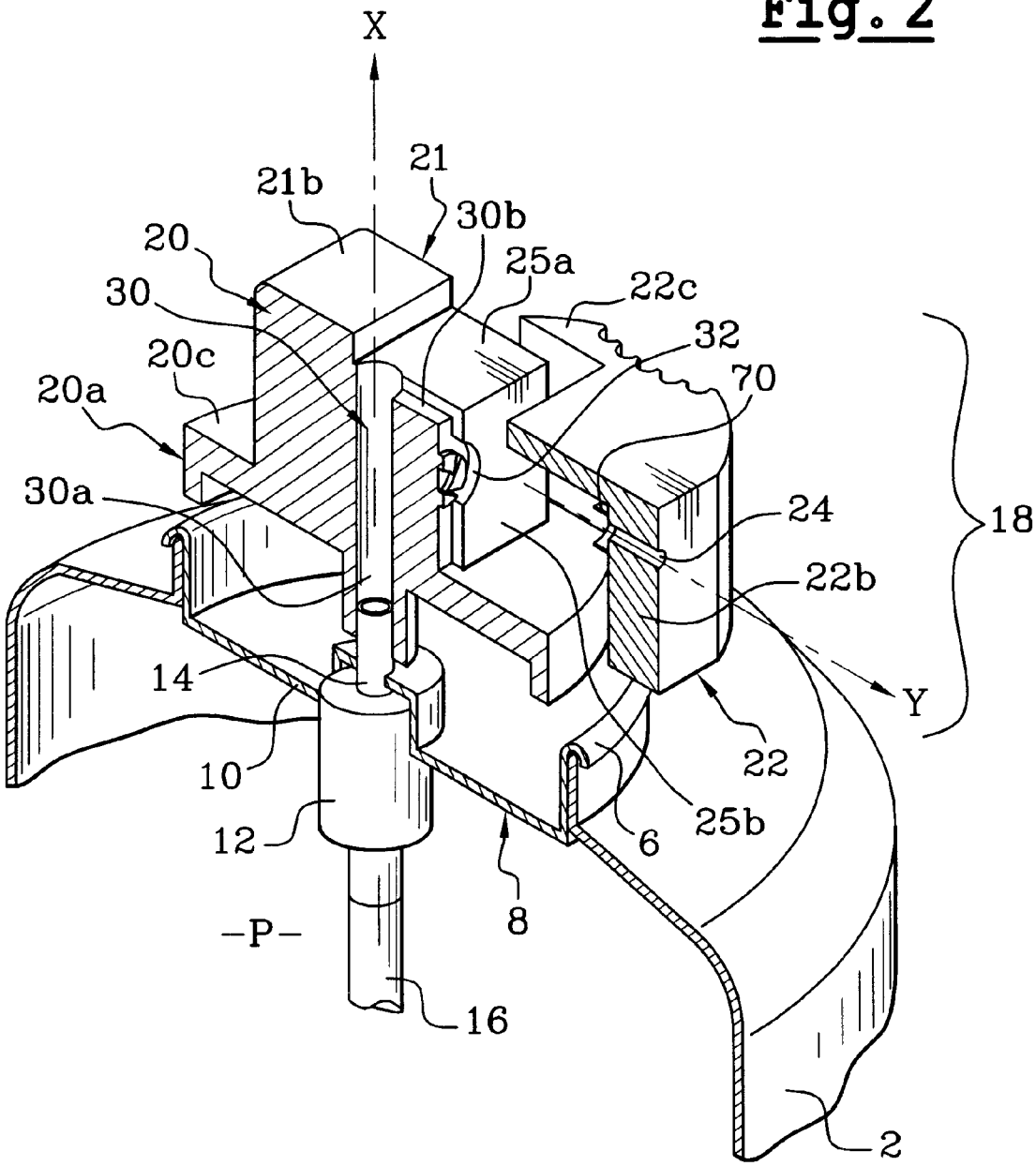

The reservoir 2 may have a cylindrical body, as shown in FIG. 1. This cylindrical body has a closed end 4 and a rolled edge 6 defining, at its upper part, a circular opening. Fixed into this opening, for example by crimping or expansion rolling, is a valve-holder cup 8 (see FIG. 2). The cup 8 at its center forms a cylindrical cavity 10 in which the body of a dispensing member 12 (e.g. a dispensing valve or pump) is mounted. A first end of the dispensing member 12 includes an actuating stem 14 emerging outwards and passing through the center of the cup 8. The axis of the actuating stem 14 is coincident with the axis X of the reservoir. Inside the reservoir 2, a second end of the dispensing member 12 is a continued by a dip tube 16 extending toward the bottom of the container or reservoir. This dip tube is intended to convey the product contained in the reservoir to the dispensing member 12. The dispensing member 12 may be a male or female valve of the push-in type, or alternatively a valve that is actuated by tipping the stem 14 sideways. In another alternative, the dispensing member 12 may be a pump configured to be actuated by moving the stem.

Mounted on the free end of the stem 14 is a dispensing head 18 made in two parts 20, 22. A first part forms the body 20 of the dispensing head. This body 20 is mounted on the stem 14. The first part or body 20 includes a duct portion 30*a* for operably connecting the body 20 to the stem 14. The body 20 also includes a part of a supply or dispensing duct 30 leading to a dispensing orifice 24. Mounted on the body 20 of the first part is a second part of the dispensing head, the end element 22. The second part or end element 22 includes a dispensing orifice 24, in flow communication with the dispensing passages or dispensing duct 30 of the body 20. The end element 22 is mounted so that it can move selectively, with respect to the body 20, as will be detailed hereinafter. The end element 22 opens and closes the dispensing head 18 to allow access to the interior duct parts 30, 32 of the dispensing head 18 when the end element is in the open position, and to allow product to travel from the dispensing member 12, via the dispensing duct 30, to the dispensing orifice 24 when the end element is in the closed position.

Figure 3A:
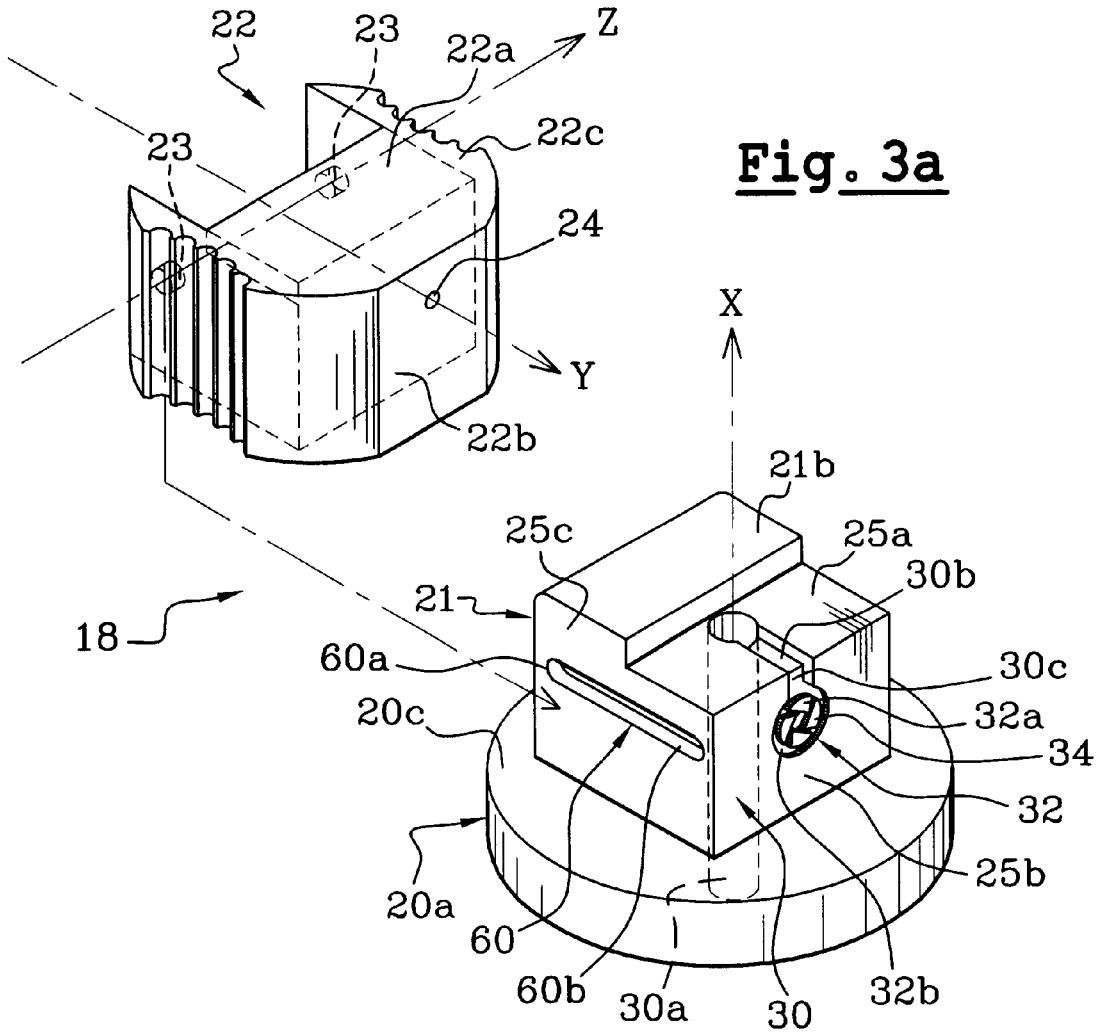

The body 20 forms a base 20*a* defining a circular plateau 20*c*. A hub, which encloses duct portion 30*a,* emerges from the center of the plateau 20*c* and is directed towards the dispensing member or valve 12. The hub engages the valve stem 14 and connects the body 20 to the valve stem 14, providing flow communication between the body 20 and the dispensing member 12 as discussed above. Arranged on the plateau 20*c* is a generally parallelepipedal structure 21, which includes a front face 25*b,* two parallel side faces 25*c,* an upper face 25*a* and a culminating portion 21*b*. Produced in each of the side faces 25*c,* as best shown in FIG. 3*a,* is a cut, groove or guide element 60 that is oriented parallel to the plateau 20*c*. The ends 60*a,* 60*b* of the cut are closed.

Guide element 60 is shown in FIG. 3*a* as a straight groove, which is parallel to the plateau 20*c* throughout its entire travel. However, the concept of a guide element is not limited to a straight groove that is parallel to the plateau 20*c* throughout its entire length. For instance, guide element 60 could be curvilinear and have a straight and parallel portion, for instance, proximate to end 60*a,* and an upwardly curving portion, for instance, proximate to end 60*b*.

Figure 3B:
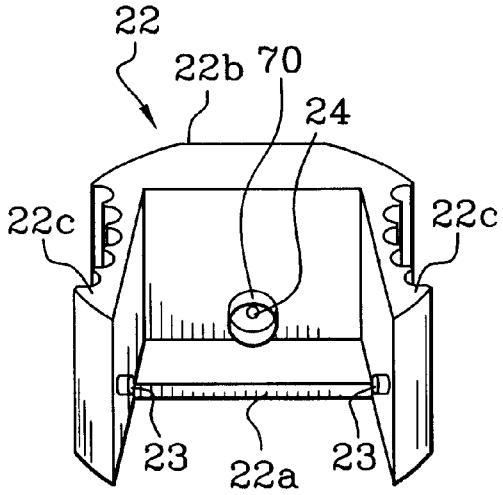
Figure 4:
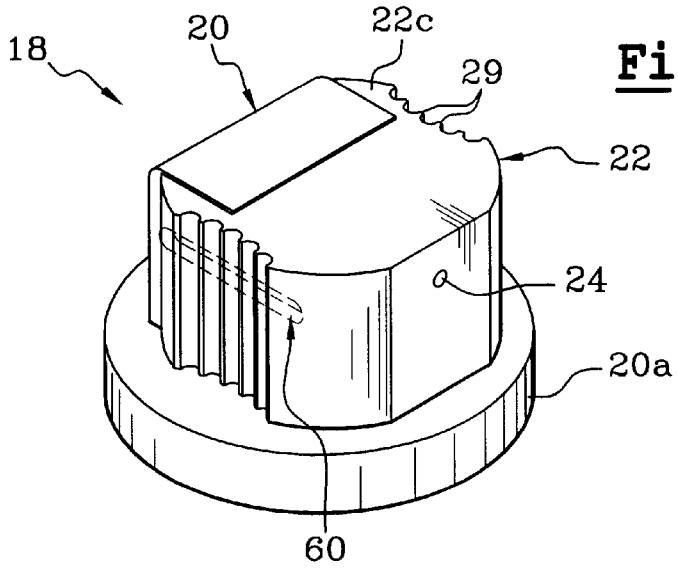
FIG. 4 depicts a perspective view of the dispensing head of FIG. 1, in the dispensing position.

As best shown in FIG. 3*b,* the movable end element 22 has two catching elements, shown as studs or projections 23, situated facing each other on the interior wall of the two parallel flanks 22*c.* These studs or projections are shown generally cylindrical and shaped in such a way that they can be lodged, in a sliding and pivoting manner, in the corresponding cuts or guide elements 60. A pivot axis Z, as shown in FIG. 3*a,* is defined by the two catching elements 23. Because the ends 60*a,* 60*b* of the cut are closed, separation of the end element 12 from the body 20 can be inhibited and accidental loss of the end element 22 can be avoided.

The shape of the movable end element 22 makes it possible, when the assembly is in the closed position (corresponding to a ready-for-use position), for the end element 22 to be placed on the structure 21. This end element 22 is fitted such that it can move on the structure 21. For instance, as shown in FIGS. 2–8, the end element is generally in the shape of a stirrup. The two parallel flanks 22*c* of the end element 22 are joined together by a perpendicular wall 22*b*. The dispensing orifice 24 is formed in the wall 22*b*. This orifice is oriented along an axis Y, which is perpendicular to the axis X. A portion of the upper face of the end element 22 is shaped as a thin plateau 22*a*. With the end element 22 in the closed position, the plateau 22*a* positions itself over the upper face 25*a* of the body 20, and aligns itself with the culminating portion 21*b* of structure 21. The flanks 22*c* cover the side faces 25*c,* and the wall 22*b* covers the front face 25*b*.

A portion of the dispensing duct 30 extends in the direction of axis X through the structure 21, opens onto the upper face 25*a,* and continues radially from axis X in the form of a radial duct 30*b*. A swirl chamber 32 is formed on the front face 25*b* and is connected to the radial duct 30*b* by a duct portion 30*c*. The swirl chamber 32 is shown upstream from the dispensing orifice 24 when the end element 22 is in the closed position. When the dispensing assembly is in the closed position, the swirl chamber 32 and the ducts 30*a*–30*c* of the dispensing duct 30 are closed by the plateau 22*a* of the moving second part 22.

Moreover, as is visible in FIG. 3*a,* the bottom of the swirl chamber 32 carries profiles 34, the height of which correspond to the depth of the swirl chamber 32. These profiles are capable of imparting to the stream of product conveyed by the dispensing duct 30 a spiral movement converging towards the center of the swirl chamber 32. Swirl chamber 32 includes a circular passage 32*b,* which is defined between the external edges of the profiles 34 and the external peripheral edge of the swirl chamber 32. Passages of decreasing cross section 32*c* are formed between the profiles 34 and lead the product P towards the center of the swirl chamber 32, while at the same time driving this product in a swirling movement about the axis Y of the dispensing orifice 24. Thus, the product P enters the circular passage 32*b* of the swirl chamber 32 and passes through the converging cross section of the passages 32*c*. The speed of the stream of product is accelerated, which encourages the product to break up into fine droplets after it has passed through the dispensing orifice 24. The use of such a swirl chamber is particularly appropriate for atomizing a product place under pressure in the reservoir 2 by a propellant gas that is not soluble in the product, such as compressed gases ($CO_2$, nitrogen, compressed air) or liquefied gases. The swirl chamber 32 is shown as being located on the body 20. Alternatively, the swirl chamber 32 could be located on end element 22.

When the end element 22 is in the closed position relative to the body 20, the wall 22*b* is pressed against the front face 25*b*. In this configuration, the dispensing orifice 24 is located directly in front of the swirl chamber 32. In this closed position, each catching element or stud 23 is lodged in the guide element or cut 60, proximate to the end 60*a*. As best shown in FIG. 3*a,* the pivot axis Z of the movable end element 22, passing through the center of the two catching elements or studs 23, is perpendicular to the axes X and Y.

In order to provide good sealing between, on the one hand, the dispensing duct 30 and, respectively, the swirl chamber 32, and, on the other hand, the movable end element 22, a sealing element 70 is provided. Such a sealing element may be formed as an annular seal situated on the movable end element 22. The annular seal fictionally engages the external peripheral edge of the swirl chamber 32. The height of the sealing element 70 is less than the depth of the swirl chamber 32. The sealing element 70 is shown as being located on end element 22 Alternatively, the sealing element 70 could be located on the body 20

A dose of product P is dispensed in the conventional way. Indeed the dispensing member 12 may be actuated simply by pressing on the upper surface 22*c* of the dispensing head 18, if the dispensing member is a push-in valve. In the case of a lateral tilt valve, the valve may be actuated by pushing the dispensing head sideways relative to axis X. When the dispensing member 12 is a pump, axial reciprocation of the stem 14 might cause dispensing.

After a dose of product P has been dispensed, product residue may remain in the dispensing duct 30, particularly in the swirl chamber 32 and/or near the dispensing orifice 24. After a prolonged period of rest, dry residue may form, for example, through evaporation of a solvent that the product might contain or through oxidation of the product. The formation of such dry residue carries the risk of entirely or partially blocking the dispensing duct 30, the dispensing passages 34 of the swirl chamber 32, and the dispensing orifice 24.

Figure 5:
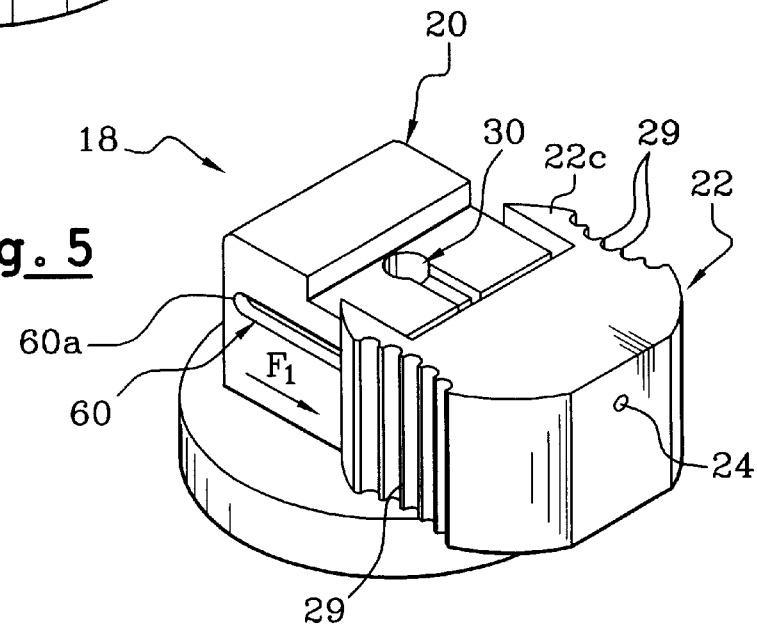
FIG. 5 depicts a perspective view of the dispensing head of FIG. 3 in a first stage of opening.
Figure 6:
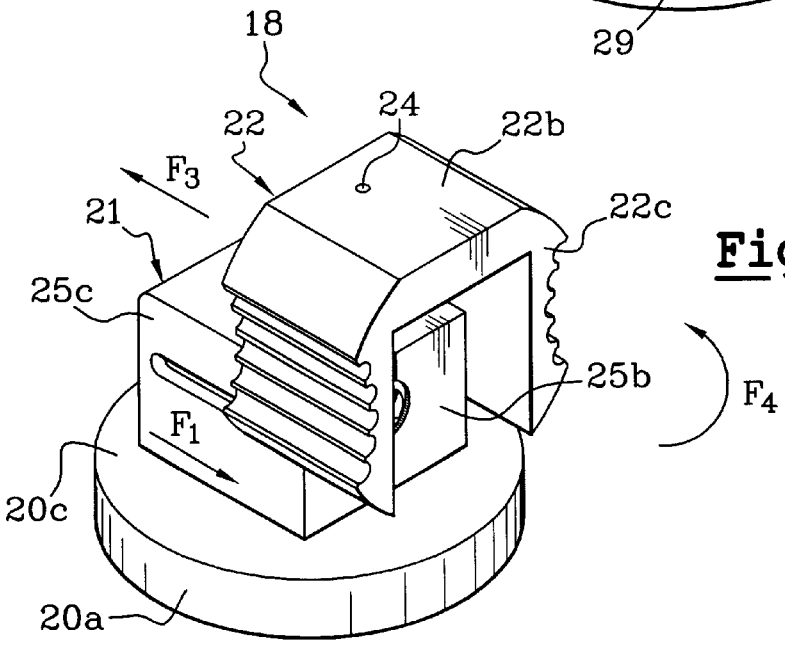
FIG. 6 depicts a perspective view of the dispensing head of FIG. 3 in a second stage of opening.
Figure 7:
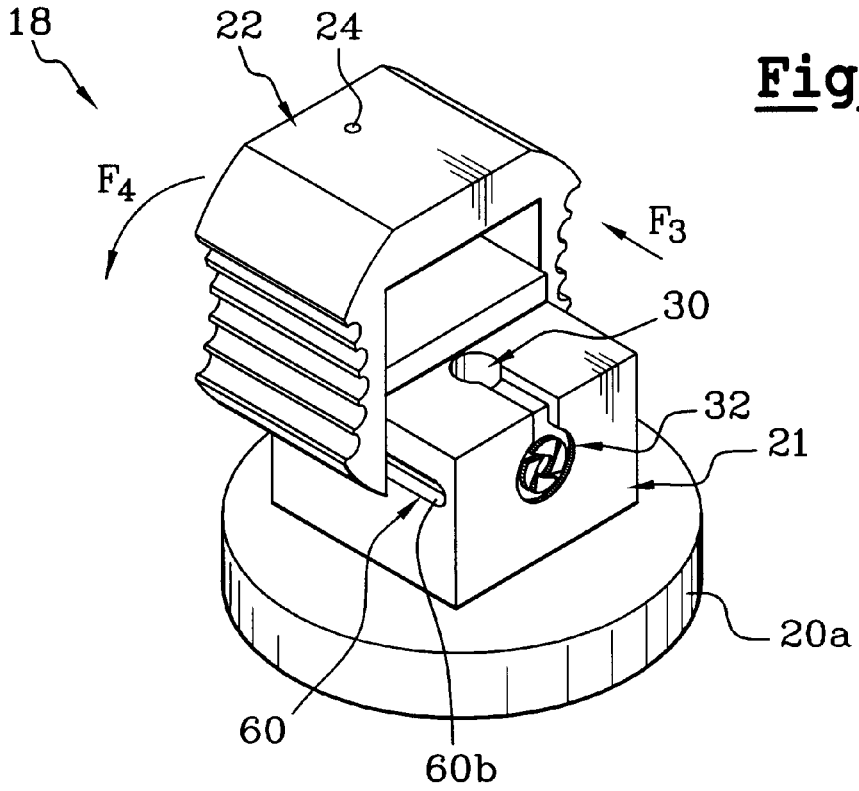
FIG. 7 depicts a perspective view of the dispensing head of FIG. 3 in a third stage of opening.
Figure 8:
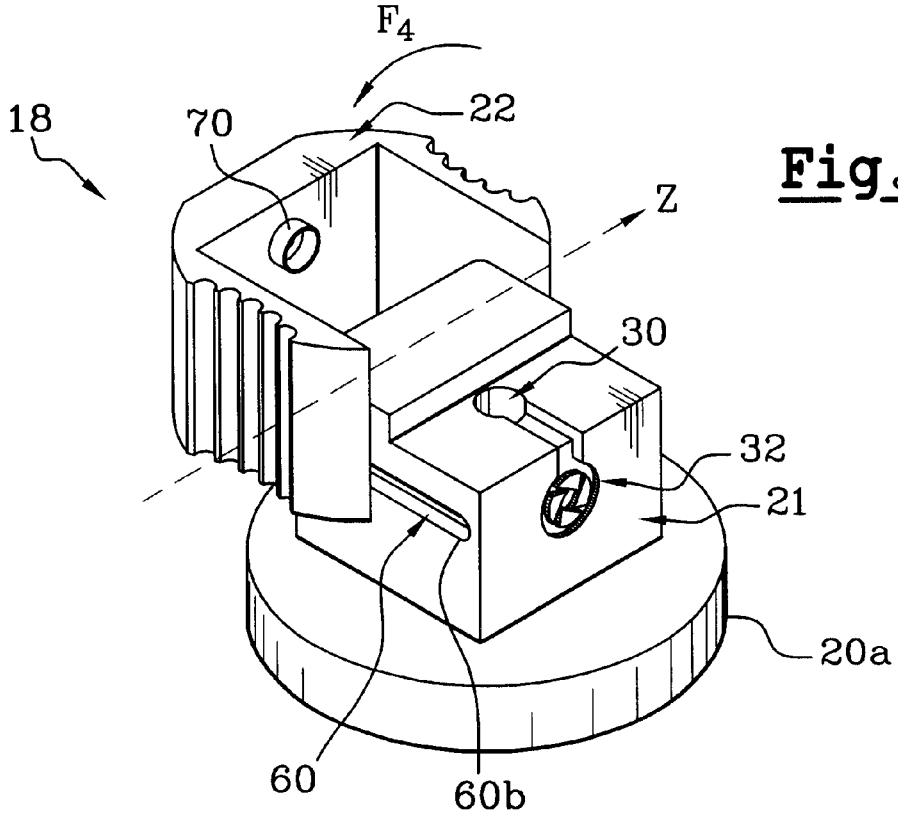
FIG. 8 depicts a perspective view of the dispensing head of FIG. 3 in a last stage of opening.

When such blocking of the dispensing head 18 occurs, the dispensing ducts 30*a*–30*c* and/or the dispensing passages 34 of the swirl chamber 32 and/or the dispensing orifice 24 might need to be cleaned. For this purpose, as shown in FIG. 5, the user translates the movable end element 22 in the direction of the axis Y, which passes through the dispensing orifice 24. To allow the user's fingers to get a good grip on the end element 22, the flanks 22*c* may include a non-slip profile 29. The dispensing orifice 24 is may be a cylindrical hole, with a diameter of from about 0.15 mm to about 1 mm. The depth of this orifice 24 may be from about 0.1 mm to about 1 mm Through this translational movement described hereinabove, the catching elements or studs 23 slide along the guide elements or cuts 60 towards the second end 60*b* (see FIG. 5, arrow $F_1$). At the end of this sliding movement, the end element 22 is pivoted upwards, about the axis Z, by about 90 degrees, (see FIG. 6, arrow $F_2$). As is best shown in FIG. 7, the movable end element 22 is then translated in the direction of the arrow $F_3$ back towards the first end 60*a* of the guide element or cut 60. As illustrated in FIG. 8, the end element 22 is then pivoted downwards, about the axis Z, by about 90 degrees, in the direction of the arrow $F_4$ The exact amount of the pivoting of the end element 22 is not critical, so long as the movement of the end element 22 allows the dispensing duct 30 and swirl chamber 32 to be exposed.

Thus, the dispensing duct 30, the swirl chamber 32 and the interior of the dispensing orifice 24 become accessible and can be cleaned. The two parts 20, 22, with the end element 22 in the opened position, can therefore be cleaned, for example by mechanically removing the residue or by rinsing, for example under a tap.

Once the body 20 and the end element 22 have been dried, the movable end element 22 is repositioned on the structure 21 of the body 20 in the closed position. Moving the end element 22 from the opened position to the closed position may be accomplished by a succession of manipulations performed in the opposite direction/order from the direction/order for opening the end element 22. The construction of the dispensing head optionally makes it possible, after cleaning, for the dispensing orifice 24 to be repositioned with respect the dispensing duct 30 and/or swirl chamber 32 in a perfectly repeatable position.

Figure 11:
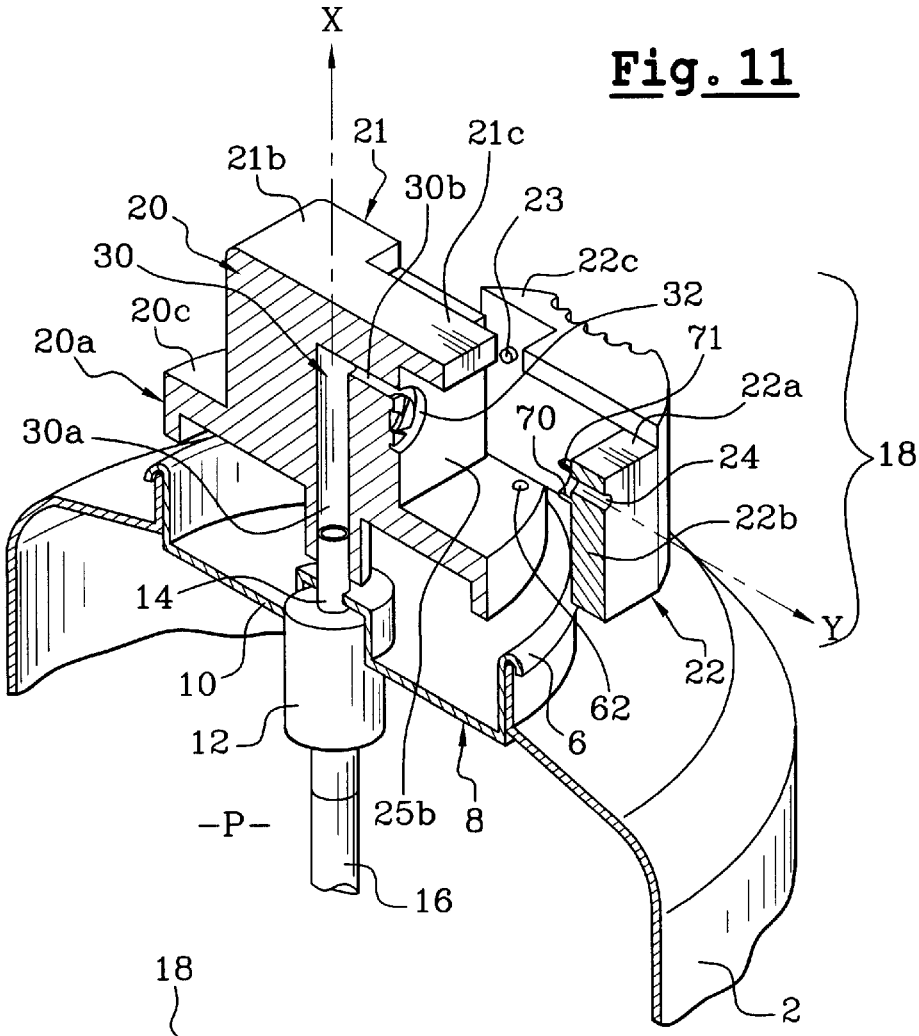
FIG. 11 illustrates a partial cross-sectional view of the optional embodiment of FIG. 10.

A second optional embodiment of the dispensing head 18 is depicted in FIGS. 9 to 11. This dispensing head is roughly similar to the dispensing head of the first optional embodiment described previously. Thus, only the differences are described hereinafter. The reference number for parts that are identical, with respect to the first embodiment, have been kept.

The optional embodiment of FIGS. 9 to 11 differs from the optional embodiment described previously in that the dispensing head 18 has locking elements for restraining or inhibiting pivoting and translational movement of the movable end element 22 with respect to the body 20. These locking elements secure the end element 22 on the body 20 during use. As shown in FIG. 10, the top 21*b* of the body 20 is shaped as a plateau, a portion 21*c* of which emerges radially from the front face 25*b* of the body. On the upper face of the front wall 22*b* of the end element 22 there is a notch 22*a* capable, when the end element 22 is in the closed position, i.e., during use of the dispensing head, of accommodating the radially emerging portion 21*c*. Thus, while product is being dispensed, a pivoting upward movement of the end element 22 is prevented. Furthermore, two short pips 62, as best seen in FIG. 9, are arranged on the plateau 20*c* of the body, right in front of the movable end element 22, so as to prevent accidental translational sliding of the end element.

With reference to FIG. 11, it can be seen that the central part of the dispensing duct 30 is in flow communication with and opens radially onto a radial extending portion 30*b* of the duct 30 passing through the body 20. This radial portion 30*b* in turn opens into the swirl chamber 32. The wall 22*b* of the end element 22 carries, on its interior face, a sealing element or ring 70 that collaborates in a sealed manner with the side wall of the swirl chamber 32. The sealing element or ring 70 surrounds the portion of the dispensing orifice 24 proximate the swirl chamber 32 when the end element is in a closed position. The interior face of the sealing element 70 has a number of grooves oriented parallel to the axis Y and allowing product to pass from the radial duct 30*b* into the swirl chamber 32.

Figure 12:
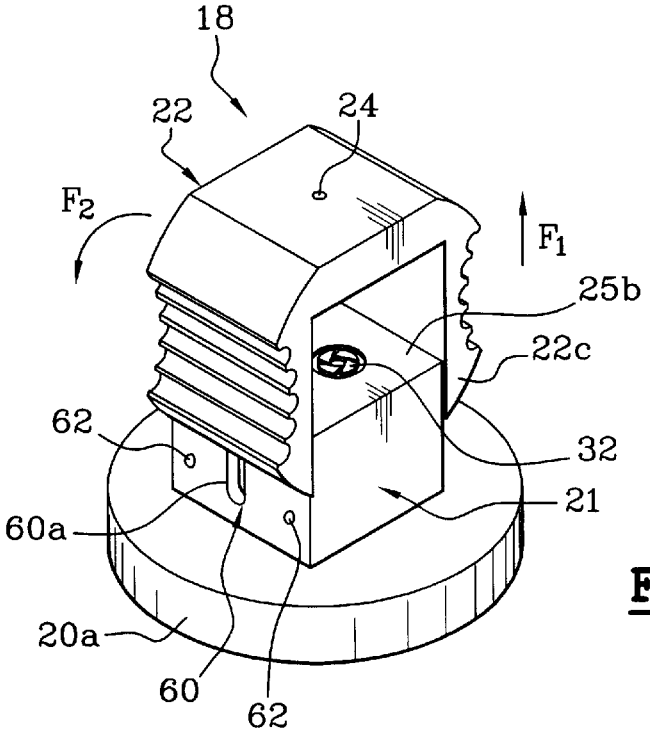
FIG. 12 depicts a perspective view of a dispensing head according to a third optional embodiment.

In order to clean the inside of the dispensing head 18, the user grasps the movable end element 22 between the thumb and forefinger, for example, and moves it in the direction of the axis Y of the dispensing orifice 24. Through this operation, the front wall 22*b* of the end element 22 overcomes the pips 62 and the portion 21*c* releases the notch 22*a*. The end element 22 can then perform a pivoting movement as described in the description of the operation of the previous embodiment FIG. 12 shows another optional embodiment whereby a dispensing assembly 18 is shaped in such a way that product is dispensed essentially along the longitudinal axis X of the dispensing assembly. It can be seen that the body 20 of the dispensing head 18 ends in a flat top 25*b*. Formed on this top 25*b* is a swirl chamber 32. This swirl chamber 32 is in flow communication with a pump or valve stem 14 of a dispensing member 12 via passage means (not depicted) passing through the body 20. A portion of the structure 21 of the body 20 is surmounted by the movable end element 22. For this configuration, the structure of the end element 22 is similar to the structure of the corresponding end element 22 of the optional embodiment previously described. Likewise, the shape of the swirl chamber 32 in this optional embodiment is similar to the shape of the swirl chamber described with reference to FIGS. 3*a,* 7 and 8.

Two guide elements 60 (e.g. cuts) are formed on the outer faces of two side walls 25*c* of the structure 21 of the body 20. These cuts are parallel to one another. Moreover, in this configuration, these cuts have an orientation parallel to the axis X, which coincides with the longitudinal central axis of the valve stem 14. Two catching elements (e.g. studs, not visible in FIG. 12) of the end element collaborate each with one of the cuts 60. A pivot axis passes through these two studs and is oriented perpendicular to the axis X. In the closed position, i.e., the position of use, these studs would be situated near the lower end 60*a* of the cuts 60. Two pips 62 are made on the side wall 25*c,* on each side of the end 60*a* of the cut 60, collaborating, in the position of use, with a complementary profile borne by the end element 22. The pips 62 hold the movable end element 22 in place on the body 20 when the dispensing assembly is being used.

To actuate the valve, the user presses on the plateau 20*c* of base 20*a* of the body 20.

If any portion of the dispensing ducts or passages or swirl chamber becomes clogged, the user moves the end element 22 in the direction of the arrow $F_1$, as shown in FIG. 12, as far as the upper end of the cut 60, opposite the end 60*a,* in order to uncover the dispensing orifice 24 and gain access to the swirl chamber 32.

Then, through a pivoting movement through about 90 degrees, the user pivots the movable end element 22 in the direction of the arrow $F_2$. In this opened position, the swirl chamber 32 and the inside of the dispensing orifice 24, are accessible and can be cleaned After cleaning, the end element 22 is returned to the closed position, the position of use, by a succession of operations performed in the reverse order to the operations for opening the dispensing head 18.

It will be apparent to those skilled in the art that various modifications and variations can be made to the structure and methodology of the present invention without departing from the scope or spirit of the invention. Thus, it should be understood that the invention is not limited to the examples discussed in the specification Rather, the present invention is intended to cover modifications and variations of this invention, provided they fall within the scope of the following claims and their equivalents

What is claimed is:

1. A method for cleaning product residue from a dispensing head comprised of a body and an end element movable with respect to the body, the method comprising:

translating the end element relative to the body;

pivoting the end element relative to the body to thereby gain access to at least one dispensing duct defined at least in part by the body;

removing product residue from the at least one dispensing duct;

pivoting the end element relative to the body; and translating the end element relative to the body to thereby place a dispensing orifice defined by the end element in flow communication with the at least one dispensing duct.

2. The method of claim 1, wherein the pivoting further includes gaining access to a swirl chamber defined by at least one of the body and the end element, and wherein the removing further includes removing product residue from the swirl chamber.

3. A dispensing head for actuating a dispensing member provided on a dispenser, the dispensing head comprising:

a body configured to be operatively coupled to the dispensing member;

an end element including a dispensing orifice; and at least one dispensing duct, wherein the dispensing head is configured to provide movement of the end element with respect to the body between a closed position and an opened position, wherein when the body is operatively coupled to the dispensing member and the end element is in the closed position, the dispensing orifice is in flow communication with the dispensing member via the at least one dispensing duct, wherein when the end element is in the opened position, at least a portion of the at least one dispensing duct is capable of being cleaned, and wherein the movement of the end element between the closed position and the opened position includes at least one translational movement of the end element and at least one pivoting movement of the end element about a pivot axis.

4. The dispensing head of claim 3, wherein at least a portion of the translational movement is along a first axis that coincides with a longitudinal axis of the dispensing orifice.

5. The dispensing head of claim 4, wherein the pivoting axis is substantially perpendicular to the first axis.

6. The dispensing head of claim 5, wherein one of the body and the end element includes at least one projection and wherein the pivot axis passes through the projection.

7. The dispensing head of claim 4, wherein one of the body and the end element includes at least one groove aligned in a direction parallel to the first axis.

8. The dispensing head of claim 3 wherein one of the body and the end element includes a guide member.

9. The dispensing head of claim 8, wherein the guide member includes at least one groove.

10. The dispensing head of claim 8, wherein the other of the body and the end element includes a catching member that engages the guide member.

11. The dispensing head of claim 10, wherein the catching member includes at least one projection.

12. The dispensing head of claim 11, wherein, in the opened position, the end element is secured to the body.

13. The dispensing head of claim 11, wherein the at least one projection defines the pivot axis.

14. The dispensing head of claim 10, wherein the guide member, in collaboration with the catching member, secures the end element to the body when the end element is in the opened position.

15. The dispensing head of claim 3, wherein, in the closed position, the end element is restrained from being displaced, via the pivoting movement, relative to the body.

16. The dispensing head of claim 3, wherein, in the closed position, the end element is inhibited from being displaced, via the translational movement, relative to the body.

17. The dispensing head of claim 3, wherein one of the body and the element includes at least one raised projection for inhibiting the translational movement of the end element relative to the body when the end element is in the closed position.

18. The dispensing head of claim 3, wherein, in the opened position, the end element is secured to the body.

19. The dispensing head of claim 3, wherein displacement of the end element relative to the body from the closed position to the opened position is accomplished via a first translational movement, a first pivoting movement, a second translational movement and a second pivoting movement.

20. The dispensing head of claim 3, wherein displacement of the end element relative to the body from the closed position to the opened position is accomplished via the translational movement followed by the pivoting movement through about 180 degrees.

21. The dispensing head of claim 3, wherein the at least one dispensing duct includes a swirl chamber.

22. The dispensing head of claim 21, wherein, with the end element in the closed position, the swirl chamber is in flow communication with the dispensing orifice.

23. The dispensing head of claim 22, wherein the end element partly delimits the swirl chamber.

24. The dispensing head of claim 23, wherein one of the body and the end element includes a sealing element for preventing leaks between the body and the end element.

25. The dispensing head of claim 3, wherein the end element includes a swirl chamber in flow communication with the dispensing orifice.

26. The dispensing head of claim 25, wherein the body partly delimits the swirl chamber.

27. The dispensing head of claim 3, wherein the end element partly delimits the at least one dispensing duct.

28. A method for cleaning product residue from the dispensing head of claim 3, the method comprising translating the end element relative to the body;

pivoting the end element relative to the body to thereby gain access to the at least one dispensing duct;

removing product residue from the at least one dispensing duct;

pivoting the end element relative to the body; and translating the end element relative to the body to thereby place the dispensing orifice in flow communication with the at least one dispensing duct.

29. The method of claim 28, wherein the translating includes movement of the end element along a straight line, wherein the straight line is parallel with a central axis of the dispensing orifice.

30. The method of claim 28, wherein the translating includes movement of the end element along a curvilinear line.

31. The method of claim 30, wherein at least a portion of the movement of the end element is along a straight line which is parallel with a central axis of the dispensing orifice.

32. A dispensing head for a dispenser including a dispensing member, the dispensing head comprising:

a body defining at least a portion of at least one dispensing duct, wherein the dispensing duct is configured to provide flow communication with the dispensing member when the dispensing head is operatively coupled to the dispensing member;

an element including a dispensing orifice, wherein the end element is movably coupled to the body for movement from a closed position to an opened position;

at least one guide element provided on one of the body and the end element; and at least one catching element provided on the other of the body and the end element, wherein the catching element slidably engages the guide element during at least a portion of the movement of the end element from the closed position to the opened position, and wherein the catching element defines a pivoting axis around which the end element pivots relative to the body during at least a portion of the movement of the end element from the closed position to the opened position.

33. The dispensing head of claim 32, wherein the guide element includes at least one groove and the catching element includes at least one projection.

34. The dispensing head of claim 33, wherein the groove is a slot.

35. The dispensing head of claim 33, wherein at least a portion of the groove is parallel with an axis centered in the dispensing orifice.

36. The dispensing head of claim 33, wherein the projection is a stud.

37. The dispensing head of claim 32, wherein the guide element is provided on the end element and the catching element is provided on the body.

38. The dispensing head of claim 32, wherein one of the body and the end element includes a swirl chamber in flow communication with the dispensing orifice and with the at least one dispensing duct when the end element is in the closed position.

39. A dispensing head for a dispenser including a dispensing member, the dispensing head comprising:

a body configured to be operatively coupled to the dispensing member, the body defining at least a portion of at least one dispensing duct; and an end element including a dispensing orifice, the end element being movably coupled to the body, wherein the body includes at least one groove distinct from the at least one dispensing duct, wherein the end element includes at least one stud, and wherein the stud moves in the groove when the end element moves from a closed position to an open position.

40. The dispensing head of claim 39, wherein the at least one stud slidably engages the at least one groove during at least a portion of the movement of the end element from the closed position to the opened position.

41. The dispensing head of claim 40, wherein the at least one stud defines a pivoting axis about which the end element pivots during at least a portion of the movement of the end element from the closed position to the opened position.

42. The dispensing head of claim 39, wherein one of the body and the end element includes a swirl chamber.

43. The dispensing head of claim 42, wherein the other of the body and the end element partly delimits the swirl chamber.

44. The dispensing head of claim 42, wherein the swirl chamber includes profiles that at least partially define dispensing passages of decreasing cross-sectional area.

45. The dispensing head of claim 39, wherein one of the body and the end element includes a sealing element.

46. A dispensing assembly for dispensing a product, the dispensing assembly comprising:

a reservoir for containing the product;

a dispensing member operatively associated with the reservoir; and the dispensing head of claim 7.

47. The dispensing assembly of claim 46 further including the product, wherein the product is a cosmetic product.

48. The dispensing assembly of claim 47, wherein the cosmetic product includes a solvent, and wherein the cosmetic product forms a residue upon evaporation of the solvent.

49. The dispensing assembly of claim 47, wherein the cosmetic product is capable of undergoing oxidation, and wherein the cosmetic product forms a residue upon oxidation.

50. The dispensing assembly of claim 47, wherein the valve is one of a push-in valve and a lateral tilt valve.

51. The dispensing assembly of claim 46, wherein the dispensing member is a valve.

52. The dispensing assembly of claim 46, wherein the dispensing member is a pump.

* * * * *

UNITED STATES PATENT AND TRADEMARK OFFICE

CERTIFICATE OF CORRECTION

PATENT NO. : 6,622,931 B2
DATED : September 23, 2003
INVENTOR(S) : Philippe Bonningue It is certified that error appears in the above-identified patent and that said Letters Patent is hereby corrected as shown below:

Column 12,
Line 60, “an element” should read -- an end element --.

Column 14,
Line 23, “claim 7.” should read -- claim 3. --.

Signed and Sealed this

Twenty-seventh Day of January, 2004

JON W. DUDAS
*Acting Director of the United States Patent and Trademark Office*